US005524345A

United States Patent [19]

Eichhorn

[11] Patent Number: 5,524,345

[45] Date of Patent: Jun. 11, 1996

[54] DRY SHAVING APPARATUS WITH A SHORT-HAIR CUTTER AND A SLIDABLE LONG-HAIR TRIMMER

[75] Inventor: Reinhold Eichhorn, Idstein, Germany

[73] Assignee: Braun Aktiengesellschaft, Kronberg, Germany

[21] Appl. No.: 321,117

[22] Filed: Oct. 11, 1994

[30] Foreign Application Priority Data

Oct. 23, 1993 [DE] Germany ..... 43 36 231.1

[51] Int. Cl.[6] ..... B26B 19/02; H01H 15/16

[52] U.S. Cl. ..... 30/34.1; 30/43.92; 30/45; 74/480 R; 74/475

[58] Field of Search ..... 30/34.1, 42, 43.1, 30/43.9, 43.92, 45; 74/110, 471 R, 475, 480 R, 527

[56] References Cited

U.S. PATENT DOCUMENTS

| | | | |
|---|---|---|---|
| 4,283,848 | 8/1981 | Messinger et al. | 30/34.1 |
| 4,941,259 | 7/1990 | Wolf | 30/43.1 X |
| 5,054,199 | 10/1991 | Ogawa et al. | 30/34.1 |
| 5,289,636 | 3/1994 | Eichhorn et al. | 30/43.92 |

FOREIGN PATENT DOCUMENTS

| | | | |
|---|---|---|---|
| 0529479 | 8/1992 | European Pat. Off. . | |
| 2093824 | 1/1972 | France . | |
| 3729257C2 | 7/1989 | Germany | B26B 19/10 |
| 4039681A1 | 12/1990 | Germany . | |
| 4125213A1 | 7/1991 | Germany . | |
| 4117988C2 | 3/1993 | Germany | B26B 19/28 |

*Primary Examiner*—Richard K. Seidel
*Assistant Examiner*—Jay A. Stelacone
*Attorney, Agent, or Firm*—Fish & Richardson

[57] ABSTRACT

The invention is directed to a dry shaving apparatus with at least one short-hair cutter disposed on a housing and an actuating switch for turning an electric drive mechanism on and off as well as for adjusting a switch slide provided with a long-hair trimmer by means of a transmission device, wherein the transmission device is comprised of two pivotally mounted transmission elements, the first transmission element is pivotally mounted on the actuating switch and acted upon by a spring element, the second transmission element which is provided with notches and a control cam is pivotally mounted on the housing, is coupled to the switch slide through a control element engaging the control cam as well as a spring element, and is actuatable by the first transmission element through a detent element.

16 Claims, 7 Drawing Sheets

DRY SHAVING APPARATUS WITH A SHORT-HAIR CUTTER AND A SLIDABLE LONG-HAIR TRIMMER

This invention relates to a dry shaving apparatus with at least one short-hair cutter disposed on a housing and an actuating switch for turning an electric drive mechanism on and off as well as for adjusting a switch slide provided with a long-hair trimmer by means of a transmission device.

A dry shaving apparatus of the type initially referred to is known from DE 3 729 257 A1. To adjust the long-hair trimmer, its switch slide is coupled to the actuating switch by means of a transmission device comprised of racks and gears.

From DE 4 117 988 A1 a dry shaving apparatus is known having a short-hair cutter and a long-hair trimmer and two actuating switches provided on a side of the housing and operatively separated from each other, whereof the one actuating switch is provided for turning the electric drive mechanism of the shaver on and off, while the other actuating switch serves the function of directly adjusting the long-hair trimmer by means of a linkage mechanism.

It is an object of the present invention to provide a switch control for a dry shaving apparatus of the type initially referred to which ensures ease of motion in respect of the translation and, at the same time, the transmission of the actuating stroke of the actuating switch to a switch slide provided with a long-hair trimmer.

According to the present invention, this object is accomplished in an apparatus of the type initially referred to in that the transmission device is comprised of two pivotally mounted transmission elements, that the first transmission element is pivotally mounted on the actuating switch and acted upon by a spring element, that the second transmission element which is provided with notches and a control cam is pivotally mounted on the housing, is coupled to the switch slide through a control element engaging the control cam as well as a spring element, and is actuatable by the first transmission element through a detent element.

In a further feature of the present invention, the transmission elements are configured as one-armed lever elements each and are adapted to be coupled by means of the detent element capable of positive engagement with the notches.

It is an essential advantage of the present invention that, owing to the positive locking engagement of the detent element arranged on the first transmission element with the notch causing a pivotal motion of the second transmission element, a secure movement of the switch slide provided with a long-hair trimmer is ensured from its Off position into the operating position and back into the initial position.

It is a further advantage of the present invention that the notch causing the second transmission element to perform a pivotal motion can be preceded by at least one further notch, for example, in order to be able to assign the actuating switch of the dry shaving apparatus at least one further switching function, without the need for displacement of the switch slide provided with a long-hair trimmer, such function being, for example, the activation and deactivation of the electric drive mechanism and/or the release or locking of a movably carried shaving head.

Another essential advantage of the present invention consists in that the transmission device enables any transmission ratio of the actuating switch to the long-hair trimmer switch slide to be accomplished. In consequence, the subject-matter of this invention enables transmission ratios to be put into practice that are adapted to the individual application.

In a preferred embodiment of the present invention, a pivot bearing is provided at the one end of the transmission element and the control cam at the opposite end thereof, and a coupling element is arranged between the pivot bearing and the control cam.

The notches are preferably provided on a detent arm formed integrally with the transmission element.

Preferably, the coupling element on the transmission element is provided on a line connecting the control cam and the pivot bearing.

The control cam is preferably of an approximately triangular shape, its side walls on either side of the line being of an arcuate configuration.

The arcuate shape of the side walls of the control cam is preferably determined by an approximately rectangular transmission of motive force from the transmission element to the control element of the switch slide.

In an embodiment of the present invention, the transmission element is carried on a bearing pin provided on the housing by means of the pivot bearing.

In a further feature of the present invention, the transmission element provides a pivot bearing, the detent element and a coupling element adapted to be acted upon by the spring element.

In a preferred embodiment of the present invention, the actuating switch provides a pivot bearing for the pivot bearing of the transmission element as well as a bearing support for the spring element.

A mountable and space-saving embodiment of the present invention is characterized in that the transmission element is carried, by means of the pivot bearings, on the actuating switch on a transversely extending arm of a coulisse structure approximately on the vertical center axis.

In another preferred embodiment of the present invention, the actuating switch is comprised of an actuating element and of the coulisse structure which is adapted to be coupled to the actuating element. Preferably, the actuating element is coupled to the coulisse structure by means of a clip connection.

In order to facilitate the cooperative relationship between the actuating switch, the switch slide and the transmission device as well as the assembly of these modules, the switch slide is provided between the actuating element and the coulisse structure. It is an advantage in this arrangement that the switch slide incorporates at least one guide slot for coupling the actuating element to the coulisse structure.

An essential advantage of the present invention resides in that the first spring element and the second spring element ensure a clearance-free support of the actuating switch, the switch slide, the first transmission element and the second transmission element.

A preferred embodiment of this invention is described in the following and illustrated in the accompanying drawings, in which.

Figure 1:
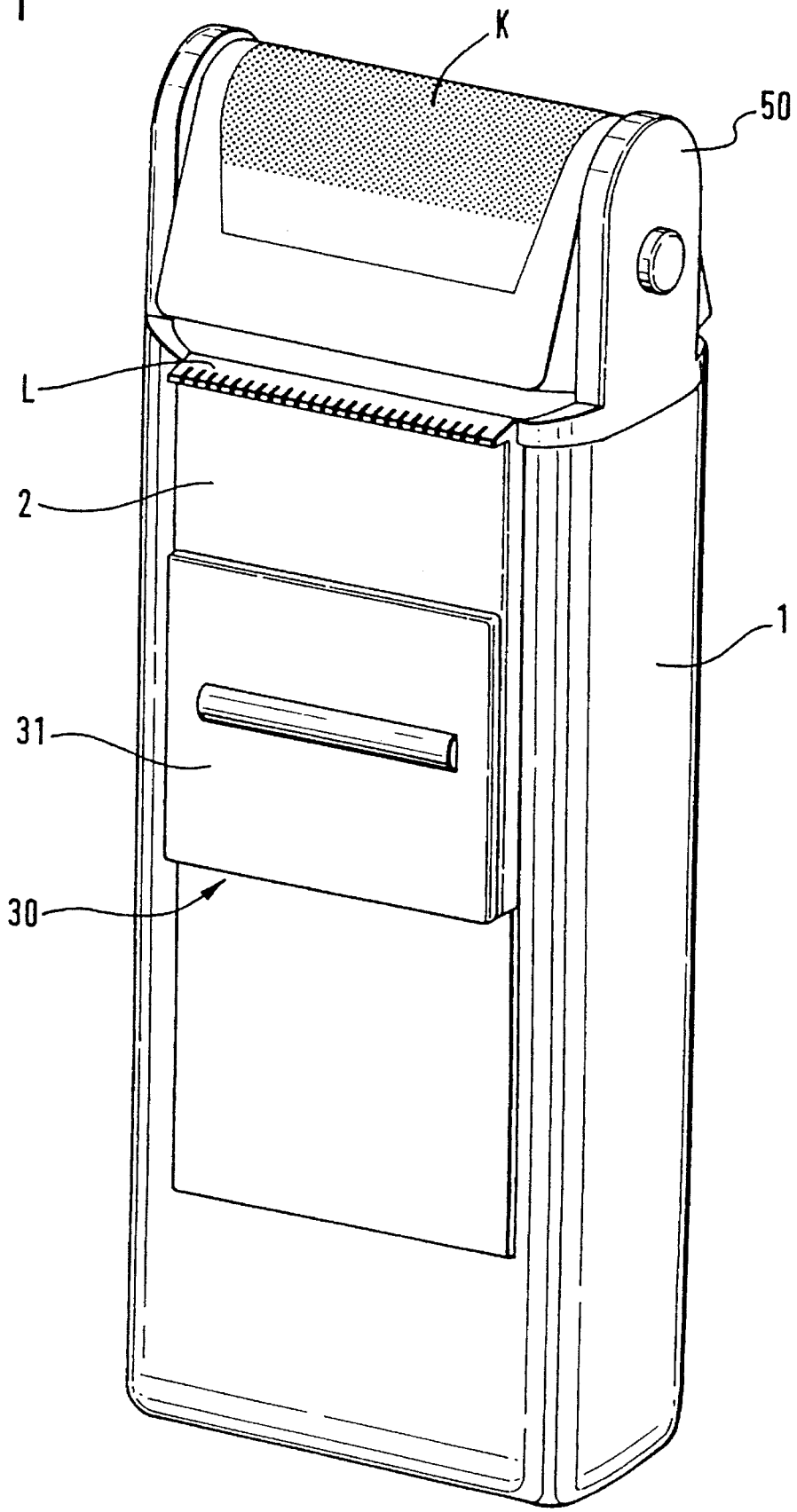
FIG. 1 is a perspective view of a dry shaving apparatus.

Referring now to FIG. 1 of the drawings, there is shown a dry shaving apparatus having a housing 1, a shaving head 50 equipped with a short-hair cutter K, as well as an actuating switch 30 for activating and deactivating an electric drive mechanism disposed in the interior of the housing 1 and for adjusting a switch slide 2 associated with a long-hair trimmer L by means of a transmission device—see FIGS. 2 to 6.

Figure 2:
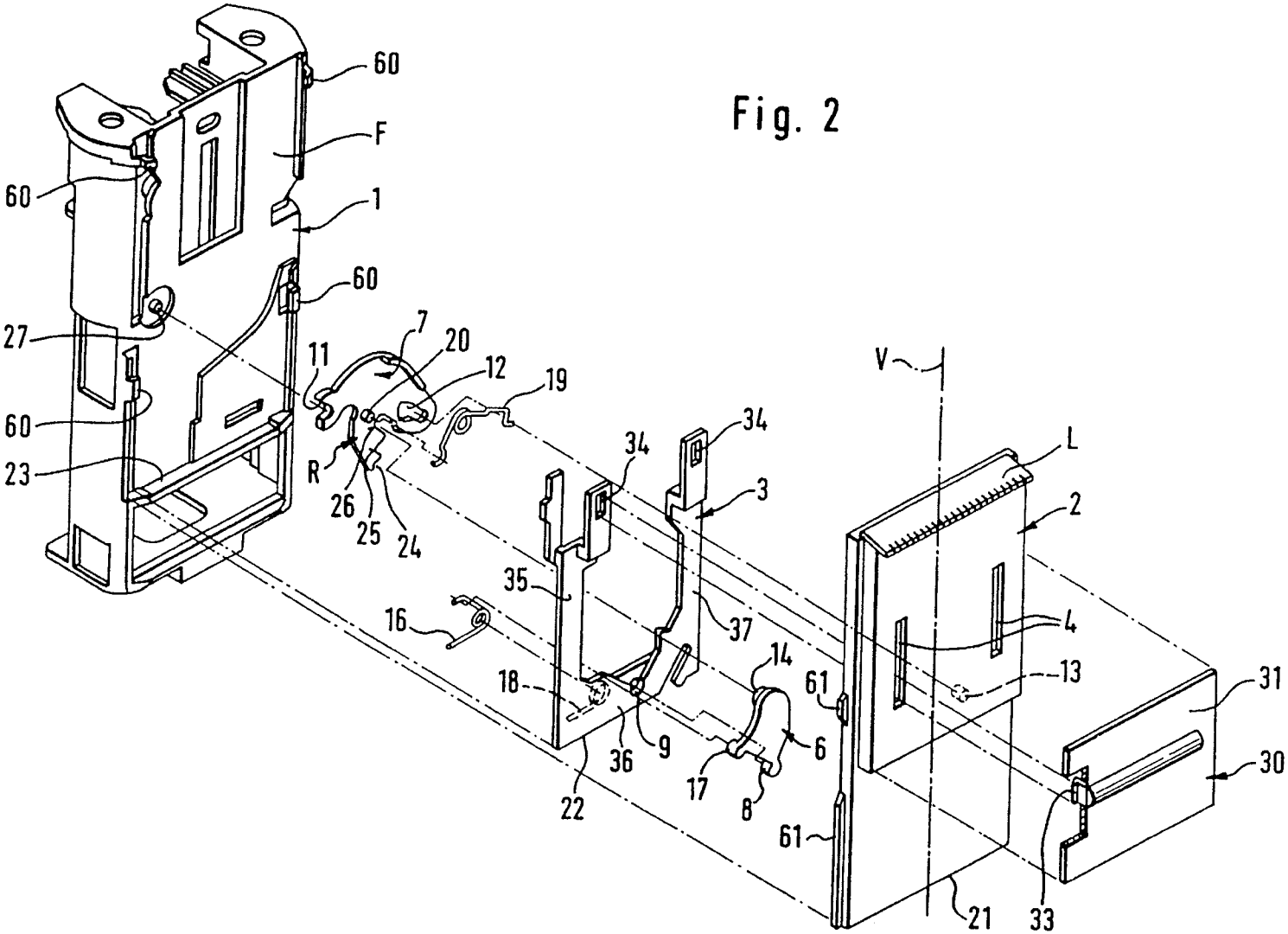
FIG. 2 is an exploded view of components of the dry shaving apparatus, including in particular actuating switch, switch slide, transmission device and housing.
Figure 6:
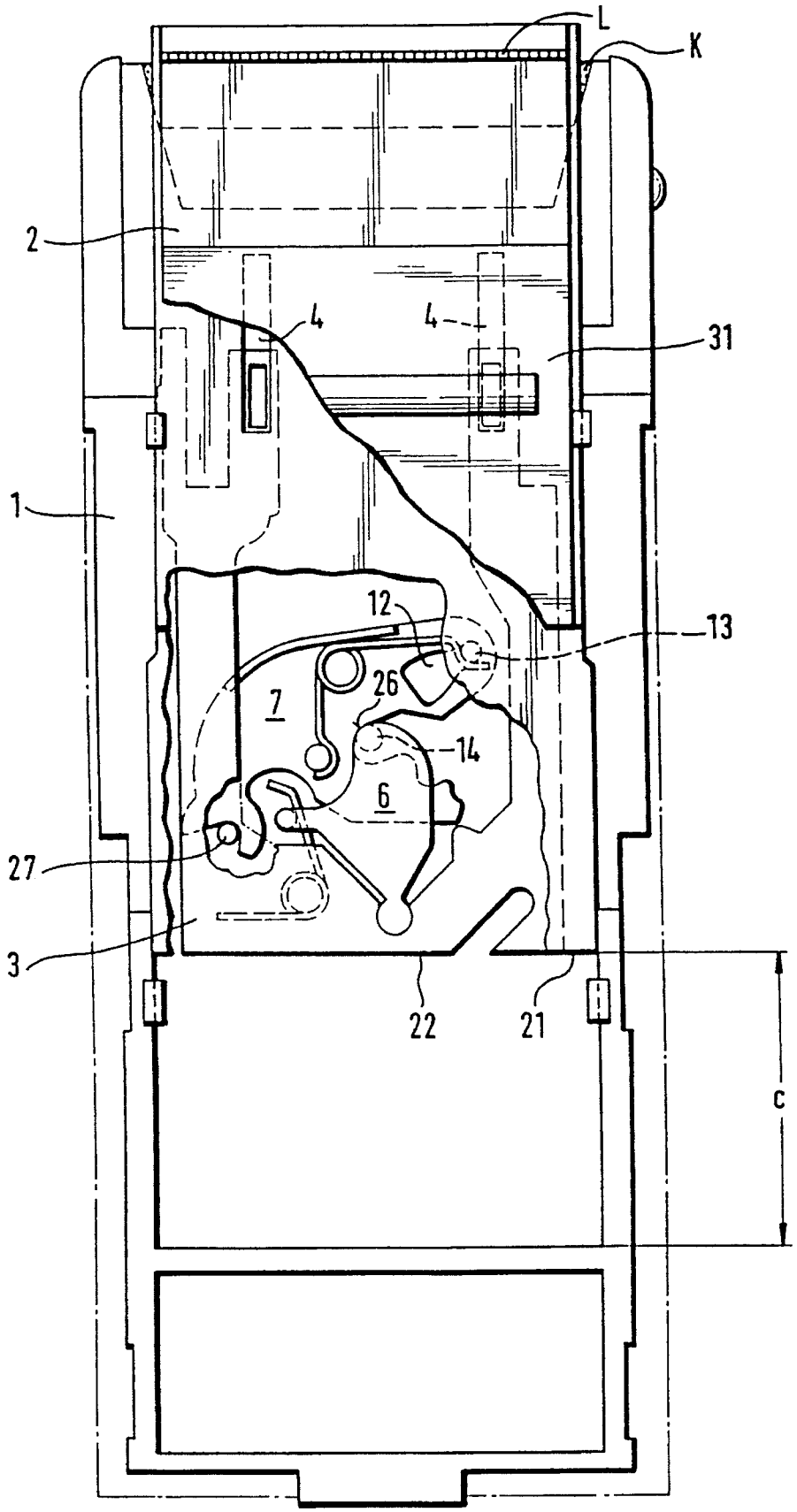

FIG. 2 shows an exploded view of cooperating components by means of which the switch slide 2 slidably mounted on the front panel F of the housing 1 and provided with a long-hair trimmer L is movable by the actuating switch 30 from an Off position—see FIG. 1 into at least one operating position—see FIG. 6.

On the front panel F of the housing 1, several U-shaped guide elements 60 are provided in which the switch slide 2 is slidably held by means of projections 61 engaging within the guide elements 60. A bearing pin 27 provided on the front panel F serves as a pivot bearing for a transmission element 7 provided with a corresponding pivot bearing 11. The transmission element 7 has at its end remote from the pivot bearing 11 a control cam 12. Between the control cam 12 and the pivot bearing 11 on a line S connecting these members—see FIG. 3—, there is provided a coupling element 20 for connection to an end of a spring element 19. The other end of the spring element 19 is coupled to a control element 13 arranged on the switch slide 2 and engaging the control cam 12 of the transmission element 7. In addition, a detent arm R including three notches 24, 25, 26 arranged in a row is formed integrally with the transmission element 7.

In the embodiment of FIGS. 1 to 6, the actuating switch 30 is composed of the actuating element 31 and the coulisse structure 3. Provided on the actuating element 31 are two clip elements 33 of which only one clip element is shown in FIG. 2. The two clip elements 33 of the actuating element 31 extend through guide slots 4 provided in the switch slide 2 parallel to the vertical center axis V and through the two clip apertures 34 provided in the coulisse structure 3, the resulting clip connection combining the actuating element 31 and the coulisse structure 3 to form a module designated as actuating switch 30. The coulisse structure 3 is of an essentially U-shaped configuration, having two parallel arms 35, 37 and one arm 36 extending transversely to the vertical center axis V. A pivot bearing 9 is provided in the transversely extending arm 36. The pivot bearing 9 receives pivotally therein the transmission element 6 by means of a pivot bearing 8. At the end remote from the pivot bearing 8, the transmission element 6 includes a detent element 14 capable of engaging with the notches 24, 25, 26. A coupling element 17 provided on the transmission element 6 serves as an end support for a spring element 16 coupled to the coulisse structure 3, for example, on the transversely extending arm 36 thereof. The arrangement of the transmission element 6 in the transversely extending arm 36 of the coulisse structure 3 by means of the pivot bearing 8 engaging in the pivot bearing 9 is selected such that this bearing structure is positioned a slight amount adjacent to the vertical center axis V. By contrast, the position of the detent element 14 on the transmission element 6 is selected such that the vertical center axis V extends through the detent element 14. As a result, the detent element 14 occupies a position lying on the vertical center axis V in any switching position of the actuating switch 30.

In the following, the individual switch settings of the embodiment will be described in more detail with reference to FIGS. 3 to 6. Because of the stacked arrangement of the components of the dry shaving apparatus, they have been partially cut away in the FIGS. 3 to 6 where appropriate.

Figure 3:
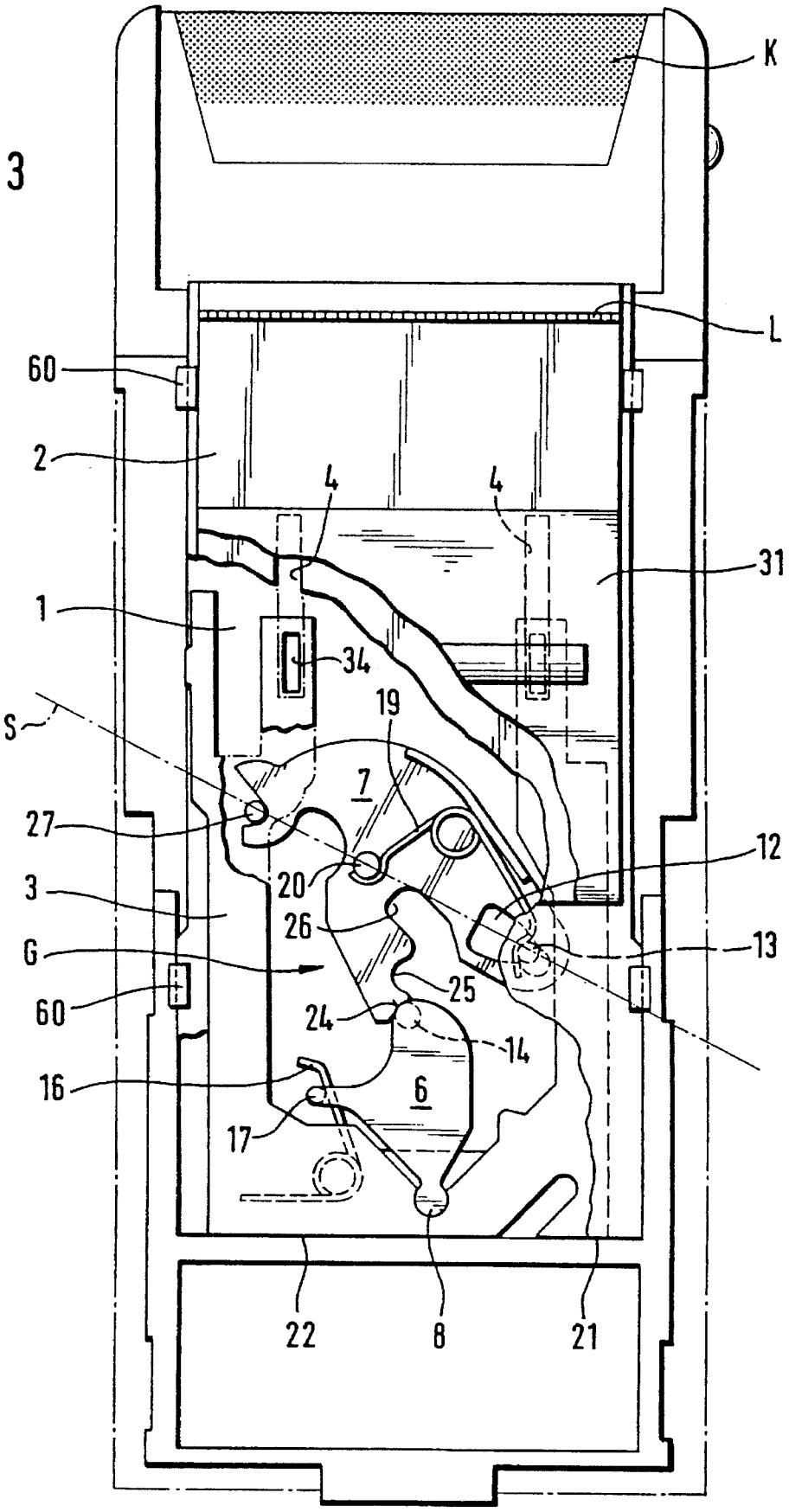
FIGS. 3 to 6 are front views of a dry shaving apparatus showing various switching positions of a transmission element coupled to the actuating switch.

FIG. 3 shows the dry shaving apparatus in the "Off" position. The bottom edge 21 of the switch slide 2 and the bottom edge 22 of the coulisse structure 3 rest against a stop 23 in the housing 1, see FIG. 2. The detent element 14 and the notches 24, 25, 26 lie on the vertical center axis V of the housing 1. Under the action of the spring element 16, the detent element 14 engages with the notch 24 of the transmission element 7.

Figure 4:
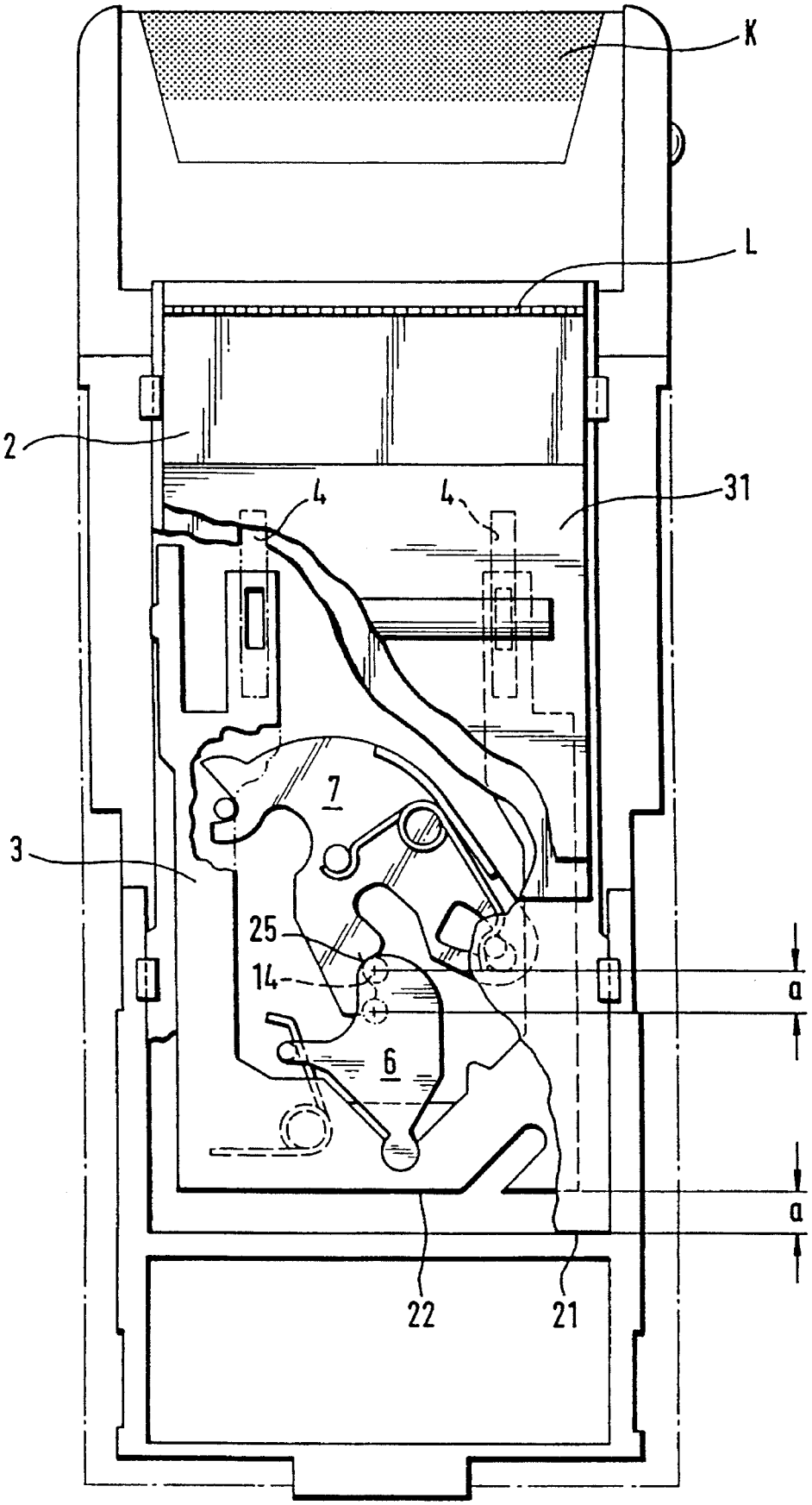

To activate the short-hair cutter K, the coulisse structure 3, together with the transmission element 6, is shifted upwardly by an amount a as shown in FIG. 4, such shifting motion being caused by the actuating element 31 of the actuating switch 30 which extends with its clip elements 33 through the guide slots 4 configured as slotted holes in the switch slide 2 to engage with the clip apertures 34 of the coulisse structure 3. The detent element 14 then engages with the notch 25. As this actuating travel proceeds, an electric microswitch not shown in the drawings which is provided in the housing 1 for activating and deactivating the electric drive mechanism of the dry shaving apparatus is actuated by the coulisse structure 3. The position of the transmission element 7 and thus the position of the longhair trimmer L are maintained unchanged.

Figure 5:
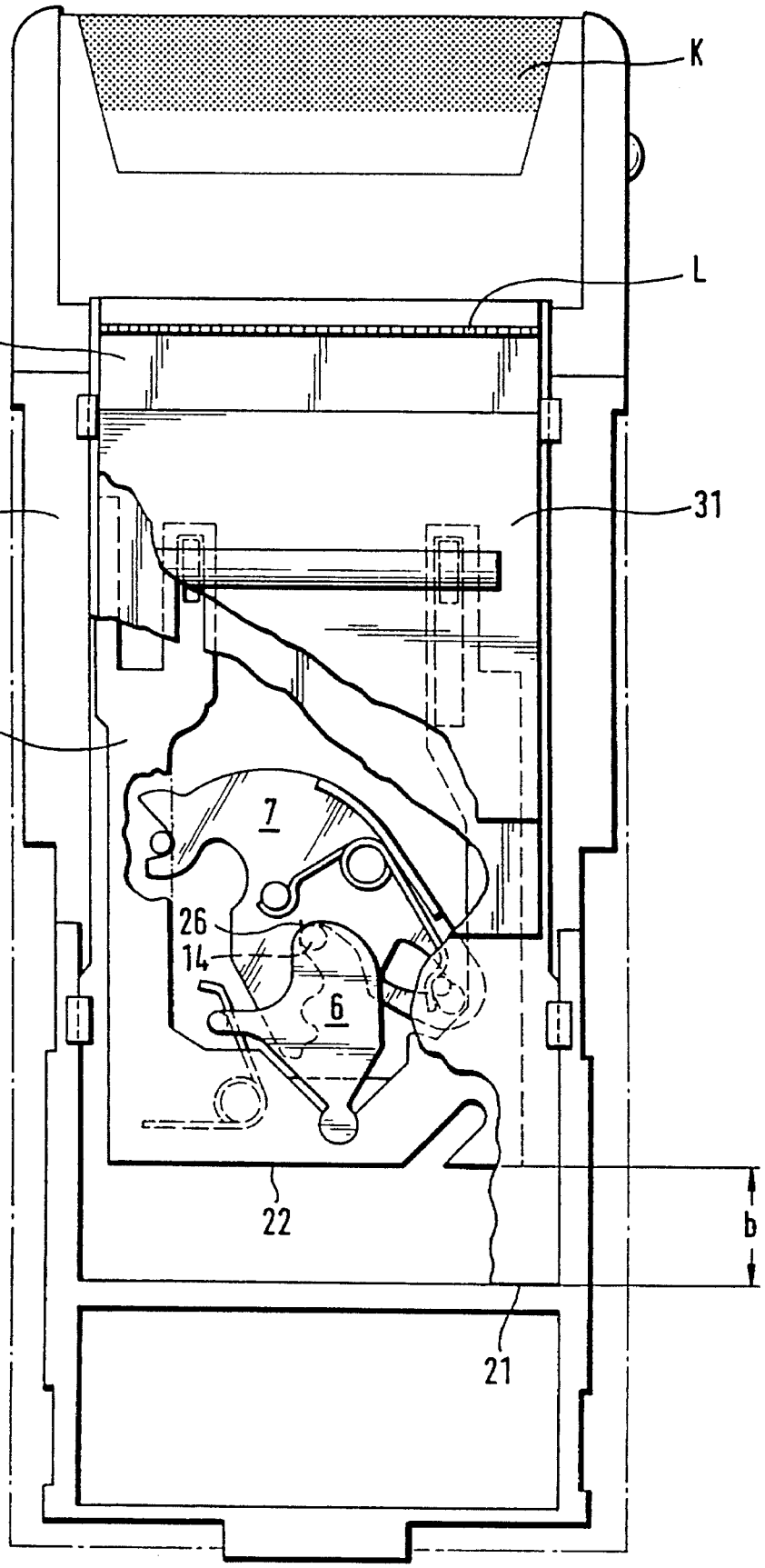

In FIG. 5, on continuing the shifting motion of the coulisse structure 3 through the actuating element 31, thus causing engagement of the detent element 14 with the notch 26, the position of the short-hair cutter K is pivoted by an angle of 20°, approximately by means of, for example, a mechanism not shown. This facilitates the manipulation of the electric shaving apparatus for special areas of the skin. On this displacement of the actuating switch 30 by an amount b, the position of the transmission element 7 and thus the position of the longhair trimmer L are equally maintained unchanged.

Only on shifting the actuating switch 30 further by an amount c as shown in FIG. 6 will the transmission element 7 be turned about the bearing pin 27 by the detent element 14 which engages with the notch 26, the transmission element then displacing, through the control element 13 engaging the control cam 12, the switch slide 2 with its long-hair trimmer L, in accordance with the predesigned transmission ratio.

The long-hair trimmer L is thus above the shearing plane of the short-hair cutter K, in which position it can be used advantageously for the trimming of hair contours.

Returning the long-hair trimmer L to the initial position is accomplished in an equivalent way in the reverse sequence.

The transmission element 7 acts between the actuating switch 30 and the switch slide 2 as a transmission lever. In the approximately central position of the point of impact of the detent element 14 in the notch 26 according to the example shown, the length of displacement of the switch slide 2 is about double the length of displacement of the actuating switch 30. When shifting the actuating switch 30 by 14 mm, for example, the longhair trimmer L will experience a 24 mm shift.

Figure 7:
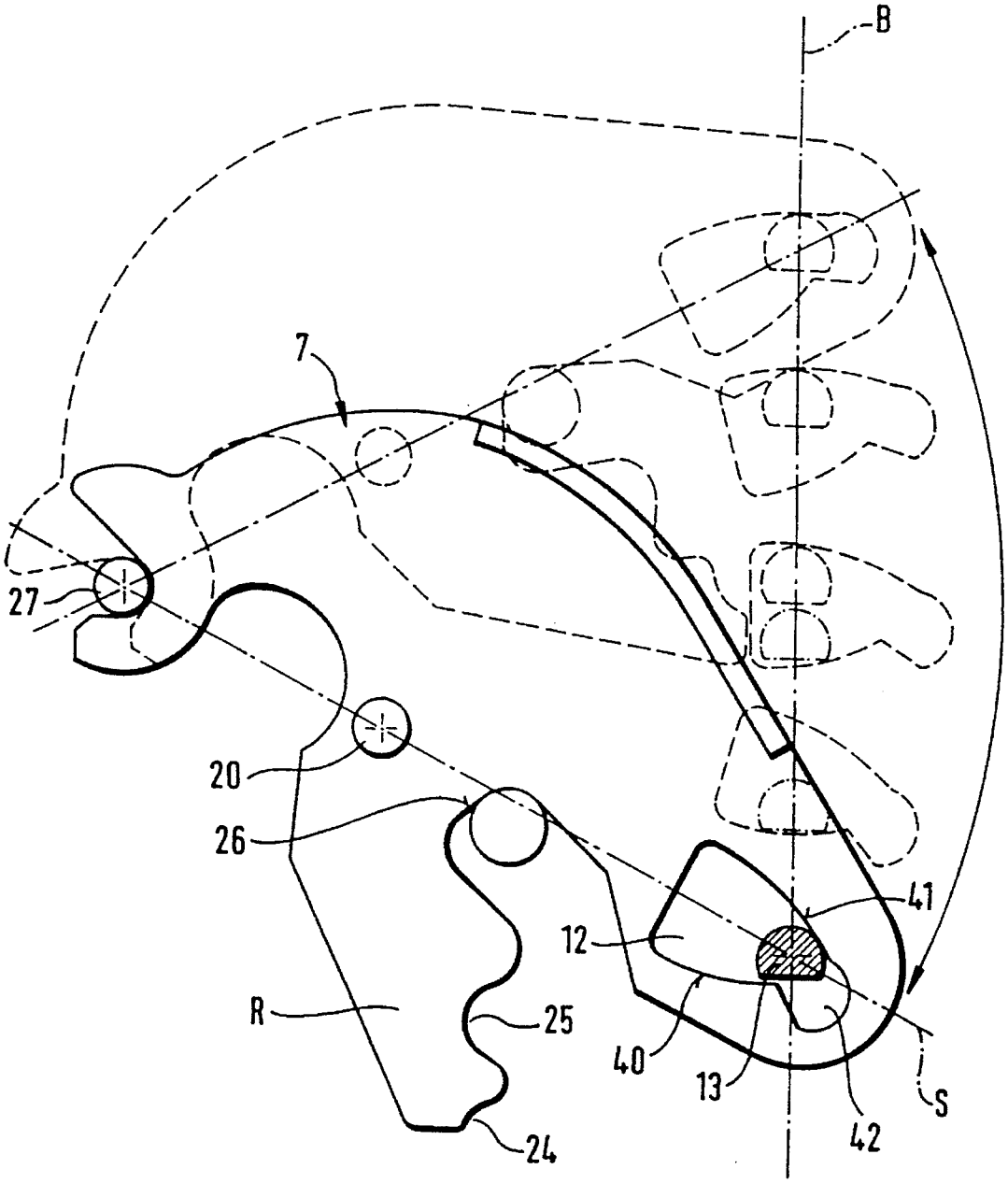
FIG. 7 is a view of a transmission element with a control cam.

FIG. 7 shows various positions relating to the sequence of movements of the control element 13 fixedly arranged on the switch slide 2 within the control cam 12 of the transmission element 7. The basic shape of the control cam 12 is essentially triangular, the two side walls 40, 41 thereof which extend on either side of the line S being of a slightly arcuate configuration, so that in the respective direction of pivotal motion of the transmission element 7 the force of displacement acts from the respective side wall 40, 41 on the control element 13 largely vertically, that is, in the direction of arrow B. As compared with an oblong control cam with parallel side walls which is equally suitable for use, this results in a reduced actuating force to be exerted on the actuating switch 30 of the dry shaving apparatus. The opening 42 provided at the end of the control cam 12 remote from the bearing pin 27 in an imaginary extension of the arcuate side walls serves to simplify and facilitate the assembly of the transmission element 7 on the bearing pin 27 and the coupling to the control element 13.

What is claimed is:

1. A dry shaving apparatus comprising:

a housing, an electric drive mechanism disposed in the housing, at least one short-hair cutter disposed on the housing, a switch slide mounted on the housing, the switch slide including a long hair trimmer and a control element, a transmission device, an actuating switch for turning the electric drive mechanism on and off as well as for adjusting the switch slide by means of the transmission device, and a first spring element and a second spring element wherein the transmission device comprises: a first transmission element including a detent element and being pivotally mounted on the actuating switch and acted upon by the first spring element, a second transmission element which is provided with notches and a control cam, wherein said second transmission element is pivotally mounted on the housing, is coupled to the switch slide through the control element engaging the control cam as well as the second spring element, and is actuatable by the first transmission element through the detent element.

2. The dry shaving apparatus as claimed in claim 1, wherein the transmission elements are configured as one-armed lever elements each and are adapted to be coupled to One another by means of the detent element capable of positive engagement with the notches.

3. The dry shaving apparatus as claimed in claim 1 or claim 2, wherein the second transmission element comprises a pivot bearing disposed on one end of the second transmission element with the control cam being provided at an opposite end thereof, the second transmission element further comprising a coupling element arranged between the pivot bearing and the control cam.

4. The dry shaving apparatus as claimed in claim 1, wherein the second transmission element comprises a detent arm formed integrally with the second transmission element, said notches being provided on said detent arm.

5. The dry shaving apparatus as claimed in claim 3, wherein the coupling element on the second transmission element is provided on a line connecting the control cam and the pivot bearing.

6. The dry shaving apparatus as claimed in claim 5, wherein the control cam is of an approximately triangular shape, and has arcuate shaped side walls disposed on either side of the line.

7. The dry shaving apparatus as claimed in claim 6, wherein the arcuate shape of the side walls of the control cam is determined by an approximately rectangular transmission of motive force from the second transmission element to the control element of the switch slide.

8. The dry shaving apparatus as claimed in claim 3, wherein the housing further comprises a bearing pin, the second transmission element being carried on the bearing pin provided on the housing by means of the pivot bearing.

9. The dry shaving apparatus as claimed in claim 1, wherein the first transmission element comprises a pivot bearing and a coupling element, the detent element and the coupling element being adapted to be acted upon by the first spring element.

10. The dry shaving apparatus as claimed in claim 9, wherein the actuating switch comprises a pivot bearing for the pivot bearing of the first transmission element as well as a bearing support for the first spring element.

11. The dry shaving apparatus as claimed in claim 10, wherein the actuating switch further comprises a coulisse structure with a transversely extending arm, the first transmission element being carried, by means of the pivot bearings, on the actuating switch on the transversely extending arm of the coulisse structure approximately on a vertical center axis of the housing.

12. The dry shaving apparatus as claimed in claim 1, wherein the actuating switch is comprised of an actuating element and of a coulisse structure which is adapted to be coupled to the actuating element.

13. The dry shaving apparatus as claimed in claim 12, wherein the actuating element comprises a clip connection and is coupled to the coulisse structure by means of the clip connection.

14. The dry shaving apparatus as claimed in claim 12, wherein the switch slide is provided between the actuating element and the coulisse structure.

15. The dry shaving apparatus as claimed in claim 14, wherein the switch slide incorporates at least one guide slot for coupling the actuating element to the coulisse structure.

16. The dry shaving apparatus as claimed in claim 1, wherein the first spring element and the second spring element ensure a clearance-free support of the actuating switch, the switch slide, the first transmission element and the second transmission element.

* * * * *